United States Patent [19]

Yamazaki et al.

[11] 4,144,783

[45] Mar. 20, 1979

[54] APPARATUS FOR BLANKING SHEET MATERIALS

[75] Inventors: Kazuya Yamazaki, Tokyo; Mikio Yonekura, Minami-ashigara, both of Japan

[73] Assignee: Amada Company, Limited, Kanagawa, Japan

[21] Appl. No.: 777,783

[22] Filed: Mar. 15, 1977

[30] Foreign Application Priority Data

Mar. 15, 1976 [JP] Japan ..... 51-27865

[51] Int. Cl.[2] ..... B26F 1/02

[52] U.S. Cl. ..... 83/216; 83/219; 83/556; 83/55

[58] Field of Search ..... 83/34, 35, 36, 41, 55, 83/556, 216, 219

[56] References Cited

U.S. PATENT DOCUMENTS

| | | | |
|---|---|---|---|
| 1,879,555 | 9/1932 | Simmons | 83/41 X |
| 3,122,042 | 2/1964 | Littell et al. | 83/556 X |
| 3,370,492 | 2/1968 | Treff | 83/34 X |
| 3,431,806 | 3/1969 | Peterson | 83/34 X |
| 3,589,221 | 6/1971 | Deegan | 83/620 X |
| 3,798,093 | 3/1974 | Levine | 83/556 X |
| 3,880,034 | 4/1975 | Sapolsky | 83/36 X |
| 3,962,941 | 6/1976 | Kober | 83/620 X |
| 4,043,234 | 8/1977 | Godin et al. | 83/55 X |

FOREIGN PATENT DOCUMENTS

| | | | |
|---|---|---|---|
| 2165224 | 7/1973 | Fed. Rep. of Germany | 83/556 |

*Primary Examiner*—Willie G. Abercrombie
*Attorney, Agent, or Firm*—Wigman & Cohen

[57] ABSTRACT

A method and apparatus for blanking wide sheet materials into a plurality of pieces of predetermined shapes are disclosed. The apparatus comprises a blanking die press and first and second carriages movable in a predetermined, numerically controlled and programmable sequence along Y and X axes, respectively, relative to the blanking die press. The blanking die includes upper and lower die holders which are adapted to be automatically rotated approximately 180° to reverse the die orientation and thereby more economically blank the sheet material with a minimum of wastage.

5 Claims, 6 Drawing Figures

APPARATUS FOR BLANKING SHEET MATERIALS

BACKGROUND OF THE INVENTION

1. Field of the Invention

The present invention relates generally to a method and apparatus for working sheet materials such as sheet metals and more particularly to a method and apparatus for blanking sheet materials into a number of pieces or blanks of desired shapes.

2. Description of the Prior Art

In many industries, sheet materials such as sheet metals are cut into a number of pieces of various shapes by presses or the like. In the fields of metal working, such working is called blanking, and pieces cut out or blanked from sheet metals are called blanks.

Sheet metals of thinner thicknesses are efficiently slit into strips of various widths at steel works and brought to market in coiled states as so-called hoops or coiled strips. Accordingly, when it is desired to obtain thinner blanks, sheet metals of desired width to be blanked are chosen on the market, and can be blanked directly by conventional presses without any pre-working. Also, coiled thinner sheet metals can be automatically fed into presses for blanking by roll feeds, gripper feeds or the like.

However, thicker sheet metals cannot be coiled, and, for convenience of transportation, they are put on the market as plain sheets of rather large widths which are usually of 915 mm. width and 1830 mm. length.

Accordingly, when it is desired to obtain thicker blanks, it has been required to shear or slit the thicker sheet metals of wide widths by use of shearing machines or the like before blanking them with presses. Also, it has been rather difficult to shear thicker sheet metals. Furthermore, since strips slit from the thicker sheet metals are short in length, they cannot be automatically efficiently fed into presses by use of roll feeds or gripper feeds or the like.

Another conventional disadvantage is that strips of sheet metals can not be economically cut into blanks for use and large parts of strips are wasted as scrap, whether such strips are slit from thinner sheet metals or thicker ones.

SUMMARY OF THE INVENTION

It is a primary object of the present invention to provide a method and an apparatus for efficiently and economically blanking sheet metals.

It is a specific object of the present invention to provide a method for economically blanking wide sheet metals.

It is another specific object of the present invention to provide an apparatus for blanking wide sheet metals directly without previously slitting them into strips.

Basically, these objects of the present invention are accomplished by providing five patterns for blanking sheet metals and providing an apparatus for moving sheet metals to be blanked in both the X and Y axes with regard to a blanking machine such as a press. Also, these objects are most completely accomplished by providing an apparatus in which tools for blanking are rotated around 180°.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENTS

The description will be made firstly with regard to the apparatus of the invention.

Figure 1:
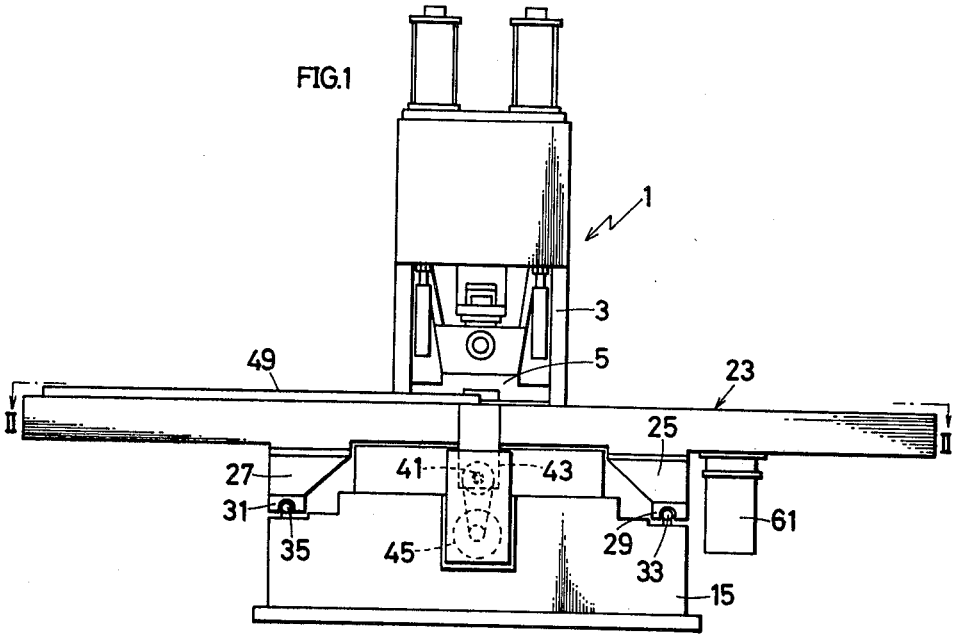
FIG. 1 is a front view of a press with an apparatus of the present invention and usable for the method of the present invention.
Figure 2:
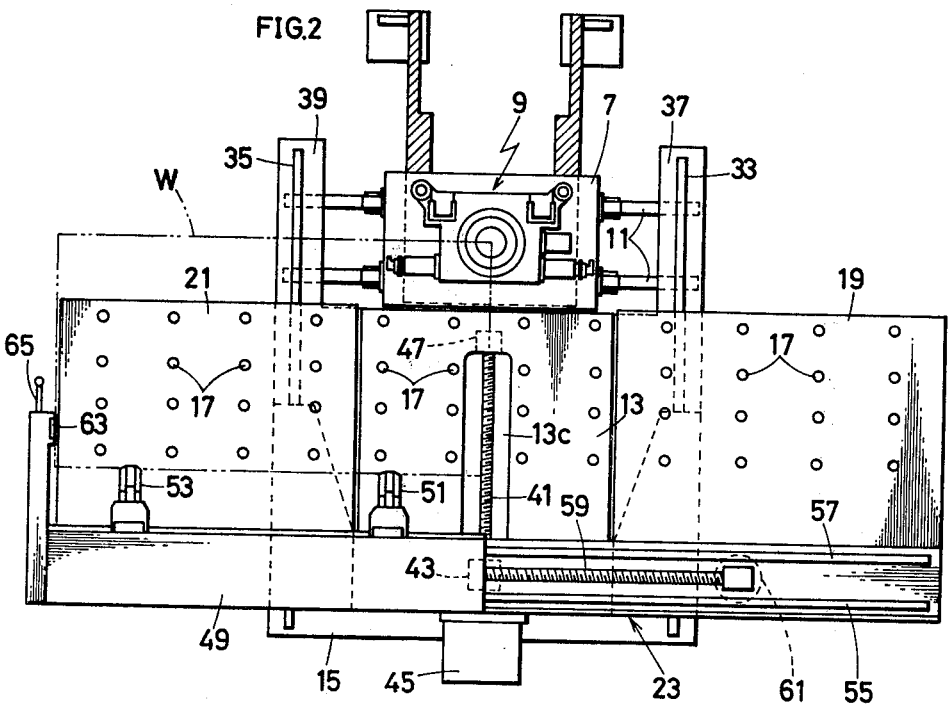
FIG. 2 is a plan view taken along the line II—II of FIG. 1.

Referring now to FIG. 1, there is shown a press generally designated by the numeral 1 which is conventional in that it is constructed of a frame 3 and has a ram 5 vertically movably provided at the front portion of the frame 3. As is also conventional, a bolster 7 is fixedly mounted just under the ram 5 as shown in FIG. 2, and it holds at its central portion a die set which is generally designated by the numeral 9 and which will be described in detail hereinafter. Thus, the ram 5 is vertically moved along the front portion of the frame 3 toward and away from the bolster 7 for operation in a conventional manner. Also, as shown in FIG. 2, slide ways 11 may be horizontally fixed to the frame 3 of the press 1 so that the bolster 7 can be moved from beneath the ram 5 to enable the die set 9 to be easily removed.

For convenience in the description hereinafter, it is here to be defined that a term "X axis" will be used to mean the right and left directions of the press 1 as viewed in FIGS. 1 and 2 and "Y axis" will mean the front and rear directions of the press 1, namely, the upper and lower directions as viewed in FIG. 2.

Referring again to FIGS. 1 and 2, there is provided a table 13 in front of the bolster 7 of the press 1, and it is fixedly mounted on a base 15 and is provided at its top surface with a plurality of ball sliders 17. In the preferred embodiment, side tables 19 and 21, also provided at their tops with a plurality of ball sliders 17, are movably provided on the both sides of the fixed table 13 so that their top surfaces are flush with that of the fixed table 13.

A carriage 23 comprising a long bar-like member is horizontally and movably mounted at right angles to the Y axis above the fixed table 13. This carriage 23 will be referred to hereinafter as the first carriage. As best shown in FIG. 1, the carriage 23 is fixedly mounted on supporting members 25 and 27 which are provided at their bottoms with slide members 29 and 31, respectively, and are slidably mounted on guide rails 33 and 35 in such a manner that their slide members 29 and 31 are received by the guide rails 33 and 35. Also, the guide rails 33 and 35 are horizontally fixedly mounted on the base 15 in parallel with each other in a manner extending along the Y axis to the both sides of the bolster 7 of the press 1. In the preferred embodiment, the rear ends of the guide rails 33 and 35 are supported by brackets 37 and 39, respectively, which are horizontally fixed to the base 15. Thus, the carriage 23 is spanned between the supporting members 25 and 27 above the fixed table 13 and is so mounted on the guide rails 33 and 35 as to horizontally move therealong in the Y axis toward and away from the bolster 7.

In the preferred embodiment, the side tables 19 and 21 are fixed to the supporting members 25 and 27 and are movable therewith together with the carriage 23 along the Y axis. Thus, the side tables 19 and 21 can be horizontally moved towards and away from the both sides of the bolster 7 together with the carriage 23.

In order to horizontally move the first carriage 23 along the Y axis, a lead screw 41 is horizontally provided along the Y axis to extend through a threaded bore horizontally formed through a depending projection 43 which is fixed to the central portion of the carriage 23. The lead screw 41 is so designed as to be driven for rotation by a motor 45 which is provided at the front portion of the base 15 in the preferred embodiment and is numerically controlled to completely accomplish the objects of the present invention in a manner to be described hereinafter. In order to enable the depending projection 43 of the carriage 23 to move along the Y axis, a channel 13*c* is horizontally formed along the Y axis through the central portion of the fixed table 13. The lead screw 41 is arranged in the channel 13*c* of the fixed table 13, and the rear end of the lead screw 41 is journaled in a bearing means 47 provided at the rear end of the channel 13*c*. Thus, when the lead screw 41 is rotated by the motor 45, the first carriage 23 is horizontally moved along the Y axis with the supporting members 25 and 27 sliding on the guide rails 33 and 35.

As best shown in FIG. 2, another carriage 49 is so provided on the first carriage 23 to be horizontally moved along the X axis, and it holds clamps 51 and 53 which are designed to clamp the worksheet W to be blanked on the tables 13, 19 and 21. The carriage 49, which will be referred to as the second carriage hereinafter, is slidably mounted on guide rails 55 and 57 which are horizontally fixed in parallel with each other onto the top surface of the first carriage 23. Also, the second carriage 49 is so designed as to be moved on and along the guide rails 55 and 57 by a lead screw 59 which is horizontally provided along the X axis on the first carriage 23 and is driven by a motor 61 provided at a suitable portion of the carriage 23. The motor 61 is also numerically controlled in order to completely achieve the objects of the present invention in a manner to be described hereinafter.

Thus, when the lead screw 59 is rotated by the motor 61, the second carriage 49 is horizontally moved along the X axis on the guide rails 55 and 57 to horizontally move the worksheet W along the X axis slidingly on the fixed central table 13 and the movable side tables 19 and 21. Also, when the first carriage 23 is moved along the Y axis on the guide rails 33 and 35 by the lead screw 41, the second carriage 49 is also moved therewith along the Y axis so as to move the worksheet W along the Y axis. Accordingly, the worksheet W can be brought to any position with regard to the press 1 by moving either or both of the first and second carriages 23 and 49. Since the motors 45 and 61 for moving the first and second carriages 23 and 49, respectively, may be numerically controlled in a well-known manner, the movements of the first and second carriages 23 and 49 can be numerically controlled by a predetermined program to move the worksheet W in both the Y and X axes.

In this connection, when it is desired to initially begin to block the worksheet W according to the present invention, the first carriage 23 is placed at the frontmost position in the Y axis on the guide rails 33 and 35 and the second carriage 49 is positioned at the left end on the first carriage 23 as shown in FIG. 2.

In order to initially position the worksheet W on the tables 13, 19 and 21, a positioning stopper 63 is provided at the side end of the side table 21 in the preferred embodiment as shown in FIG. 2. Also, the positioning stopper 63 may be so designed as to be lowered or depressed from the horizontal plane of the top points of the ball sliders of the tables 13, 19 and 21 by a lever 65 shown in FIG. 2.

Thus, the worksheet W is accurately initially positioned to be blanked, when it is clamped in engagement with the positioning stopper 63 by the clamps 51 and 53 held by the second carriage 49, as shown in FIG. 2. As described hereinbefore, the first carriage 23 is placed at the frontmost position along the Y axis and the second carriage 49 is position at the left end on the first carriage 23, when the worksheet W is initially positioned.

The objects of the present invention can be accomplished in the above described arrangements with use of conventional dies or die sets, but a novel die set or pair of upper and lower dies are provided to completely accomplish the objects of the present invention. As was mentioned above, such a die set or pair of upper and lower dies is generally designated by the numeral 9 in FIG. 2.

In blanking operation, the worksheet W is firstly moved to the rearmost end on the table 13 by the carriages 23 and 49 along the Y axis from the position shown in FIG. 2, and then it is fed into the die set 9 on the press 1 along the X axis to be blanked. After the worksheet W has been blanked during the first feeding or movement along the X axis, it is shifted or displaced by the carriage 23 along the Y axis rearwardly with regard to the press 1 and then it is again fed into the die set 9 along the X axis to be blanked. Such shifting and feeding are repeated by the carriages 23 and 49 until the whole worksheet W has been blanked. Also, such shifting and feeding by the carriages 23 and 49 can be numerically controlled by a predetermined program.

Figure 3:
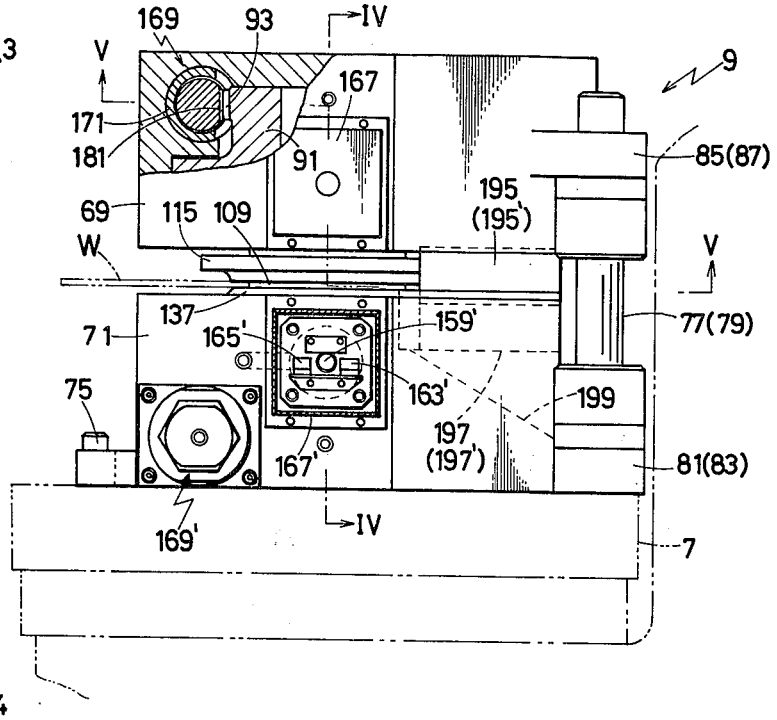
FIG. 3 is a side view of an apparatus according to the present invention with parts broken away for clarity.
Figure 4:
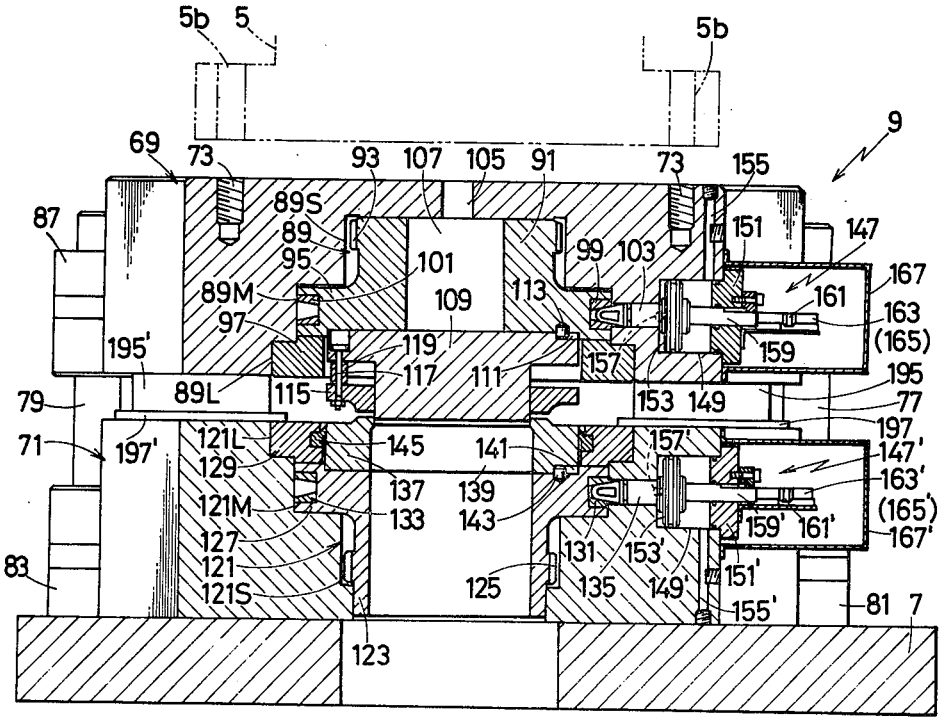
FIG. 4 is a front sectional view taken along the line Iv—IV of FIG. 3.

As best shown in FIGS. 3 and 4, the die set 9 shown as being mounted on the bolster 7 in FIG. 2 comprises a pair of upper and lower die holders 69 and 71 each formed of a thick block. The upper die holder 69 may be so designed as to be detachably fixed to the bottom of the ram 5 by bolts, for example, which are engaged in threaded bores 73 vertically formed on the top of the upper die holder 69 through bores 5*b* vertically formed through the lower portion of the ram 5. The lower die holder 71 is detachably mounted on the bolster 7 and fixed thereon by a plurality of bolts 75 in a suitable manner. Thus, the upper die holder 69 is so designed as to be vertically moved toward and away from the lower die holder 71 with the vertical movement of the ram 5. As is readily apparent to those skilled in the art, the worksheet W to be blanked is fed into between the upper and lower die holders 69 and 71.

In order to guide the vertical movement of the upper die holder 69, guide rods 77 and 79 are vertically mounted in parallel with each other to projections 81 and 83, respectively, which are formed at the lower back of the lower die holder 71 in a manner horizontally projecting therefrom. The upper die holder 69 is provided at its back with projections 85 and 87 each formed with a vertical bore and is so mounted to the guide rods 77 and 79 that its projections 85 and 87 may be vertically slidable along the guide rods 77 and 79. However, it will be understood that the guide rods 77 and 79 are not necessarily needed if the upper die holder 69 is fixed to the ram 5 in the manner described hereinbefore.

As shown in FIG. 4, the upper die holder 69 is formed at its central portion with a stepped hole 89 which is open downwardly and has a smallest top portion 89S of a smallest diameter, a medium portion 89M of a medium diameter and largest lower portion 89L of a largest diameter. Also, a round rotary member 91, which is formed at its top periphery with a gear 93 and is provided at its lower portion with a flange 95, is provided and placed in the stepped hole 89 in a manner such that its gear 93 and flange 95 are freely but fittingly rotatable within the smallest top portion 89S and the medium portion 89M, respectively, of the stepped hole 89. The rotary member 91 is held in position in the stepped hole 89 by a ring member 97 which is fitted at the largest lower portion 89L of the stepped hole 89 and is fixed to the upper die holder 69 in a suitable manner. In the preferred embodiment, the rotary member 91 is so designed as to be horizontally rotated around 180° and locked at two rotational positions, and therefore the flange 95 of the rotary member 91 is provided at its diametrically opposite peripheral portions with two bush holes 99 and 101 into which a shot-pin 103 is inserted in a manner to be described hereinafter. Also, bores 105 and 107 are vertically formed through the central portions of the upper die holder 69 and the rotary member 91, respectively, for installation of a conventional knockout means.

An upper die 109 is detachably fixed to the bottom off the rotary member 91 by bolts, for example, in a suitable manner. In order to position the upper die 109 with regard to the rotary member 91, a concavity 111 is formed at a portion of the upper die 109, and a positioning pin 113 is provided at a portion of the rotary member 91 to cooperate with the concavity 111 of the upper die 109. Of course, various dies of various shapes can be installed in the same manner. Thus, the upper die 109 is detachably held by the rotary member 91 and it can be rotated around 180° at need with the rotation of the rotary member 91. Also, in the preferred embodiment, a ring-like work holder 115 is hung to the upper die 109 therearound by a plurality of bolts 117 and is resiliently biased downwardly by a plurality of springs 119 surrounding the bolts 117 so as to hold the worksheet W in each blanking operation.

As seen from FIG. 4, the lower die holder 71 is similar in construction to the upper die holder 69 and is generally a mirror image thereof. The lower die holder 71 is also formed at its central portion with a stepped hole 121 similar to the stepped hole 89 of the upper die holder 69. However, the stepped hole 121 of the lower die holder 71 is formed through the entire thickness of the lower die holder 71 in contrast with the stepped hole 89 of the upper die holder 69. Also, the lower stepped hole 121 of the lower die holder 69 is provided with a largest top portion 121L, a medium portion 121M and a smallest lower portion 121S which are equal in diameter to the largest lower portion 89L, the medium portion 89M and the smallest portion 89S, respectively, of the stepped hole 89 of the upper die holder 69. In the stepped hole 121, there is provided a rotary member 123 which is formed at its lower portion with a gear 125 and at its top portion with a flange 127 both of which are equal in diameter and construction to the gear 93 and the flange 95 of the upper rotary member 91. Thus, the lower rotary member 123 is rotatable in the stepped hole 121 in a manner similar to the upper rotary member 91 of the upper die holder 69, and it is held in position in the stepped hole 121 by a ring member 129 fitted in the largest top portion 121L of the stepped hole 121. Also, in order to position the rotary member 123 in the stepped hole 121, two bush holes 131 and 133 are provided at diametrically opposite portions of the flange 127 of the rotary member 123, and a shot-pin 135 is provided to extend into the bush holes 131 and 133.

A lower die 137 is detachably fixed to the top of the rotary member 123 in a suitable manner so that it may cooperate with the upper die 109 to blank the worksheet W into a number of blanks. The lower die 137 is provided at its central portion with a vertical bore 139 from which the blanks cut out from the worksheet W are discharged. In order to position the lower die 137 with regard to the lower rotary member 123, a concavity 141 is formed at a portion of the lower die 137, and a positioning pin 143 is provided at a portion of the rotary member 123. Also, a ring-like dust seal 145 is interposed between the ring member 129 and the lower die 137 in order to prevent dust from entering therebetween. Thus, the lower die 137 is also detachably held by the rotary member 123 on the lower die holder 71 and it can be rotated around 180° as necessary together with the rotary member 123.

It is now readily apparent that the worksheet W is blanked between the upper and lower dies 109 and 137 when the upper die 109 is pressed down against the lower die 137 by the ram 5. Of course, various upper and lower dies of various shapes can be installed to the upper and lower die holders 69 and 71 to blank the worksheet W into various shapes of blanks. As is described hereinafter, the upper and lower dies are simultaneously rotated for the purpose of the invention.

Referring again to FIG. 4, the shot-pins 103 and 135 for locking the upper and lower rotary members 91 and 123 are designed to be hydraulically inserted into the bush holes 99 and 101 and 131 and 133. Since both of the hydraulic means for moving the shot-pins 103 and 135 for the upper and lower die holders 69 and 71 are of all the same construction, the description will be made hereinafter only as to the hydraulic means for the upper die holder 69. However, the elements or components for the lower die holder 71 corresponding to those described as to the upper die holder 69 will be designated in the drawings by the same numerals with prime designations.

As seen from FIG. 4, a hydraulic motor generally designated by the numeral 147 is provided in cylindrical chamber 149 which is formed horizontally at one side portion of the upper die holder 69 and is closed by a cap 151. The shot-pin 103 is fixed integrally to a piston 153 of the hydraulic motor 147 horizontally movable in the hydraulic chamber 149 so that it will be moved in a bore horizontally formed through the upper die holder 69 from the hydraulic chamber 149. The hydraulic fluid for working the piston 153 is supplied and drained into and out of the hydraulic chamber 149 selectively from passages 155 and 157 connected therewith. In order to indicate the engagement and disengagement of the shot-pin 103, a rod 159 is fixed to the outer side of the piston 153 and projects out through the cap 151 and it is provided at its end with a dog 161 for actuating conventional limit switches 163 and 165 (FIG. 3). Also, the outer portion of the hydraulic motor 147 is enclosed by a cover 167.

Thus, the shot-pin 103 can be engaged and disengaged with one of the bush holes 99 and 101 of the upper rotary member 91 by supplying either side of the piston 153 with the hydraulic fluid. Also, when the shot-pin 103 is kept engaged into one of the bush holes 99 and 101, the upper rotary member 91 is locked to enable the upper die 109 to blank the worksheet W in cooperation with the lower die 137. On the other hand, when the shot-pin 103 is disengaged with the bush holes 99 and 101, the rotary member 91 can be rotated.

In the above described manner, the shot-pins 103 and 135 are simultaneously actuated to lock the upper and lower rotary members 91 and 123. Also, it will be readily apparent to those skilled in the art that the hydraulic motor 147 can be operated in connection with a conventional numerical control device.

Figure 5:
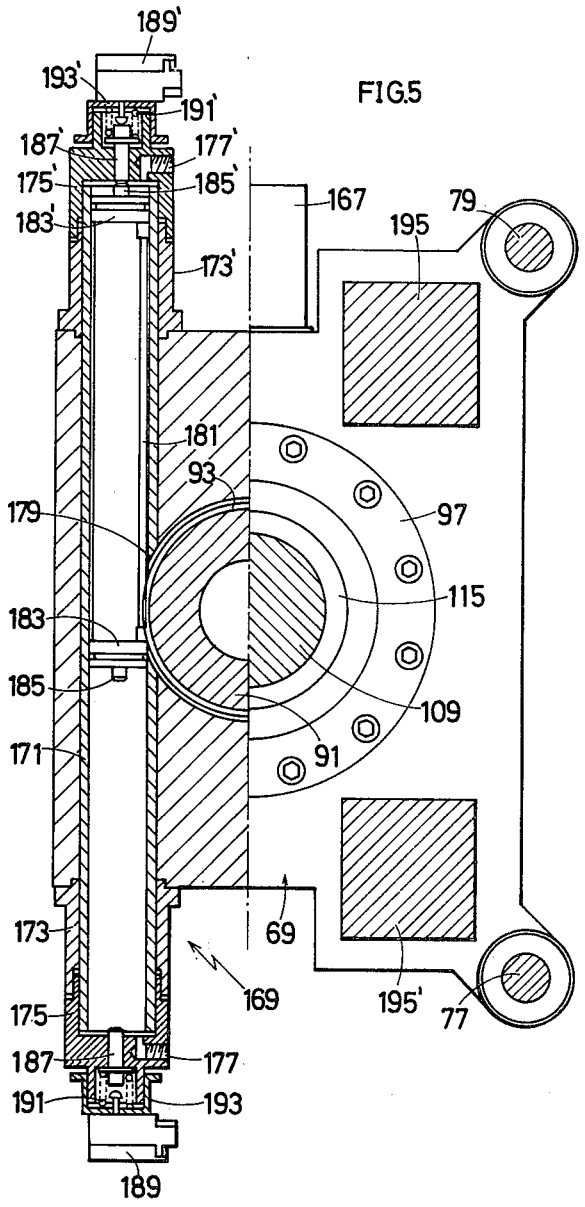
FIG. 5 is a sectional view taken along the line V—V of FIG. 3.

As shown in FIG. 5, the upper rotary member 91 for holding and rotating the upper die 109 is rotated by a hydraulic motor generally designated by the numeral 169 in the preferred embodiment. Since the lower rotary member 123 is also rotated in the same manner as the upper rotary member 91, no description is needed as to the lower rotary member 123.

The hydraulic motor 169 comprises a hydraulic cylinder 171 which is horizontally mounted in abutment with the gear 93 of the rotary member 91. The hydraulic cylinder 171 is supported by ring-like members 173 and 173' provided at the ends thereof and fixed to the die holder 69, and it is provided at ends with caps 175 and 175' which are formed with passages 177 and 177' from which the hydraulic fluid is supplied and drained. Also, the hydraulic cylinder 169 is formed at its side with an axially elonated opening 179 and a rack 181 is slidably enclosed in the hydraulic cylinder 171 so that it may engage with the gear 93 of the rotary member.

The rack 181 is provided at its ends with pistons 183 and 183' to be moved in the hydraulic cylinder 171 by the hydraulic fluid, and it is so designed as to rotate the gear 93 of the rotary member 91 around 180° at a full stroke in the cylinder 171. In order to indicate the 180° rotation of the rotary member 91, the rack 181 is provided at its ends with projections 185 and 185' which actuate through the actuating members 187 and 187' limit switches 189 and 189' provided at the ends of the cylinder 171. The actuating members 187 and 187' for the limit switches 189 and 189' are biased into the hydraulic cylinder 171 by springs 191 and 191' disposed in cup-like seats 193 and 193' provided at the ends of the cylinder 171.

According to the present invention, the upper and lower rotary members 91 and 123 are simultaneously rotated in the same manner to rotate the upper and lower dies 109 and 137 around 180° simultaneously. Although the gears 93 and 125 of the rotary members 91 and 123 are rotated by the racks 181 in the preferred embodiment, the gears 93 and 125 may be formed as worm wheels and so designed as to be rotated by worms. Also, the rotary members 91 and 123 may be so designed that their rotations are numerically controlled.

Referring again to FIGS. 3 and 4, in order to chop into pieces scraps of worksheets W from which the blanks have been cut out or blanked, two pairs of upper and lower choppers 195, 195' and 197, 197' are provided on the bottom of the upper die holder 69 and the top of the lower die holder 71, respectively. Also, chutes 199 for discharging the pieces cut from scraps of the worksheets W are provided just behind the lower die 137 on the lower die holder 71. Thus, when the scraps of the worksheets are fed into between the upper and lower choppers 195, 195' and 197, 197' along the X axis during the vertical movement of the upper die holder 69, they are cut into smaller pieces and are discharged from the chute 199.

In the above described arrangements the worksheet W to be blanked is fed between the upper and lower dies 109 and 137 along the X axis and is blanked thereby. Also, the upper and lower dies 109 and 137 can be rotated around 180° when needed and can then be locked by the shot-pins 103 and 135. The die set described above is necessary in blanking operations where the upper and lower dies 109 and 137 should be rotated to economically blank the worksheets W according to the present invention. Of course, the die set of the invention can be used also for blanking operations where the upper and lower dies 109 and 137 are not required to be rotated. However, the die set of the invention is not necessarily needed to accomplish all the objects of the invention.

Figure 6:
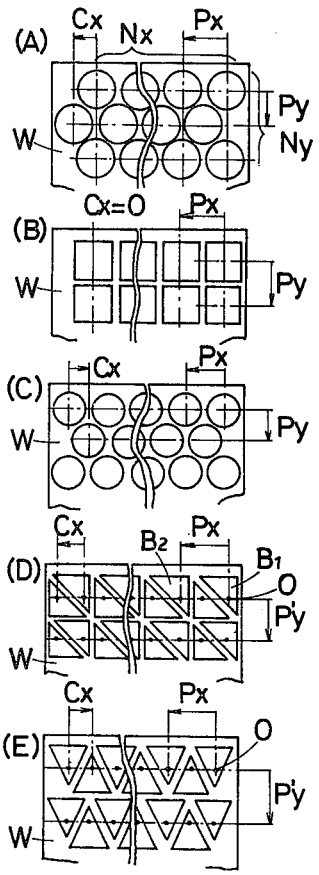
FIG. 6 shows patterns for the method of the present invention.

Referring now to FIG. 6, five patterns are shown for most economically blanking wide sheet metals that is the worksheet W into a number of blanks. In FIG. 6, "Px" designates pitches by which the worksheet W to be blanked is to be fed at each blanking along the X axis into the die set 9, and "Py" designates pitches by which the worksheet W is to be shifted or displaced along the Y axis after the worksheet W has been blanked in a full feeding along the X axis. "Cx" denotes amounts of displacement by which the worksheet W is to be displaced or shifted along the X axis simultaneously when it is being shifted along the Y axis. Also, "Nx" and "Ny" designate the numbers of blanks to be cut out from the worksheet W along the X and Y axes, respectively.

Thus, in order to economically and automatically blank sheet metals into a desired number of blanks, basically the information of PX, Py, Cx, Nx and Ny is previously stored in the memory of a numerical control device for numerically controlling the motors 45 and 61 for moving the carriages 23 and 49 by a predetermined program. In this connection, directions of Cx namely plus or minus or zero of Cx have to be stored in the memory of the numerical control device, since the worksheet W should be fed and shifted or displaced in both directions along the X axis to be blanked. Also, the starting point where the worksheet W is to be initially blanked in each of the patterns is previously stored in the memory of the numerical control device. Furthermore, it is required to program the rotations of the upper and lower dies 109 and 137 in case that the upper and lower dies 109 and 137 are required to be rotated.

In blanking operations in cases of (A), (B) and (C) of FIG. 6, the upper and lower dies 109 and 137 are not required to be rotated. Accordingly, conventional die sets or pairs of upper and lower dies can be used to blank the worksheet W according to the patterns (A), (B) and (C).

On the other hand, the upper and lower dies 109 and 137 are needed to be rotated in cases of (D) and (E) of FIG. 6. Accordingly, the die set of the present invention described in the above is necessary to blank the worksheet according to the patterns (D) and (E). In cases of (D) and (E), the rotations of the upper and lower dies 109 and 137 are also numerically controlled by a predetermined program.

In case of the pattern (A), the same number of blanks Nx are cut out from a wide worksheet W at each full feeding of the worksheet W along the X axis, and the worksheet W is fed into the die set 9 Ny times along the X axis, and it is displaced or shifted by Cx along the X axis and Py along the Y axis after each full feeding or blanking along the X axis. Also, the worksheet W is displaced or shifted by Cx in the positive direction along the X axis after the initial first feeding or blanking along the X axis is completed, but is is displaced by Cx in the negative direction along the X axis after the second full feeding along the X axis and such cycles are repeated until blankings are all completed.

The pattern (B) shows a case in which same numbers Nx of blanks are cut out from the wide worksheet W at each full feeding thereof along the X axis and the worksheet W is shifted by Py along the Y axis after each full feeding along the X axis but there is no displacement Cx along the X axis.

In case of the pattern (C), numbers (Nx) of blanks cut out from the worksheet W in feedings in the positive direction along the X axis (e.g. the first and third feedings along the X axis) are more by one than those in feedings in the negative direction along the X axis (e.g. the second and fourth feedings along X axis). In this case, the worksheet W is displaced by Cx only in the negative direction along the X axis after each full feeding along the X axis, although of course it is shifted by Py along the Y axis after each full feeding along the X axis.

The pattern (D) shows a case in which same numbers (Nx) are cut out from the worksheet W in each full feeding of the worksheet W along the X axis and the upper and lower dies 109 and 137 are rotated in the die set 9 after each full feeding along the X axis. In this case, the worksheet W is displaced only along the X axis by Cx with no displacement Py along the Y axis after feedings in the positive direction along the X axis (e.g. the first and third feedings along the X axis), and it is displaced by Cx along the X axis and by P'y along the Y axis after full feedings in the negative direction along the X axis (e.g. the second and fourth feedings along the X axis).

The pattern (E) shows a case in which numbers (Nx) of blanks cut out from the worksheet W in feedings in the positive direction along the X axis are more by one than those in feedings in the negative direction along the X axis and the upper and lower dies 109 and 137 are rotated in the die set 9 after each full feeding along the X axis. In this case too, the worksheet W is displaced only along X axis by Cx with no displacement Py along the Y axis after feedings in the positive direction along the X axis, and it is displaced by Cx along the X axis and P'y along the Y axis after feedings in the negative direction along the X axis. Also, the worksheet W is displaced in the negative direction along the X axis.

From the above description, it will be understood that the sheet metals are most economically and automatically blanked according to either of the five patterns by predetermined programs using a numerical control. As is also apparent, the five patterns can be utilized by moving the carriages 23 and 49 in the both X and Y axes according to the present invention. Also, the die set of the present invention is necessary in order to utilize the patterns (D) and (E).

Although a preferred form of the present invention has been illustrated and described, it should be understood that the device is capable of modification by one skilled in the art without departing from the principles of the invention. Accordingly, the scope of the invention is to be limited only by the claims appended hereto.

We claim:

1. Apparatus for blanking sheets comprising:

a press;

a blanking die including an upper die holder mounted to said press and a lower die holder mounted to said press beneath said upper die holder, said upper and lower die holders having upper and lower rotary members detachably supporting upper and lower dies, respectively;

means vertically reciprocating one of said upper and lower die holders relative to each other into sheet blanking cooperation;

means associated with each of said upper and lower die holders and dies for rotating said upper and lower dies independently of one another and relative to said upper and lower die holders, respectively, said rotating means including a circumferential gear arranged about each rotary member, a hydraulic cylinder fixed to each of said die holders, each cylinder including a piston formed as a rack, the rack of each cylinder being engageable with the circumferential gear of its associated rotary member; and means for positioning a sheet to be blanked relative to said blanking die from a first processing position into a plurality of processing positions according to one of a plurality of predetermined processing patterns, said one processing pattern including numerical values of a starting position on an X axis and a Y axis, a pitch Px on said X axis, a pitch Py on said Y axis, a blanking number Nx on said X axis, blanking number Ny on said Y axis and a displacement Cx on said X axis of a second processing poition of said sheet.

2. Apparatus according to claim 1, including scrap chopping means mounted adjacent said upper and lower die holders for chopping the scrap from the sheet to be blanked.

3. Apparatus according to claim 1, including limit switch means arranged in each end of the hydraulic cylinders for limiting the rotation of said rotary members to 180°.

4. Apparatus according to claim 1, wherein said rotary members have bushings arranged on opposite sides thereof at a 180° spacing, said die holders including hydraulically actuated pins engageable with said bushings for locking said rotary members in each one of two rotary positions spaced 180° apart.

5. Apparatus according to claim 1, including a work holder means suspended about said upper die for holding the sheet to be blanked in each blanking position and means resiliently biassing said work holder means downwardly against said sheet.

* * * * *